US005213085A

United States Patent [19]

Kraemer

[11] Patent Number: 5,213,085

[45] Date of Patent: May 25, 1993

[54] FUEL INJECTION PUMP FOR INTERNAL COMBUSTION ENGINES

[75] Inventor: Manfred Kraemer, Schwieberdingen, Fed. Rep. of Germany

[73] Assignee: Robert Bosch GmbH, Stuttgart, Fed. Rep. of Germany

[21] Appl. No.: 806,387

[22] Filed: Dec. 13, 1991

[30] Foreign Application Priority Data

Dec. 22, 1990 [DE] Fed. Rep. of Germany ..... 4041656

[51] Int. Cl.[5] ..... F02M 37/04

[52] U.S. Cl. ..... 123/503; 123/449

[58] Field of Search ..... 123/509, 503, 449, 495

[56] References Cited

U.S. PATENT DOCUMENTS 2,147,390 3/1935 Vaudet .
4,430,977 2/1989 Shimada ..... 123/449
4,706,626 11/1987 Hafele ..... 123/503
4,737,086 4/1988 Yamaguchi ..... 123/503
4,836,170 6/1989 Hafele ..... 123/503
4,840,161 6/1989 Eckell ..... 123/503

FOREIGN PATENT DOCUMENTS 0181402 3/1985 European Pat. Off. .
3630647 2/1988 Fed. Rep. of Germany .
3633899 4/1988 Fed. Rep. of Germany .

*Primary Examiner*—Carl S. Miller
*Attorney, Agent, or Firm*—Edwin E. Greigg; Ronald E. Greigg

[57] ABSTRACT

A fuel injection pump for internal combustion engines having at least one pump piston each of which include one control slide that is axially displaceable on the pump piston. For fuel control, the pump piston is also rotatable, while the control slide is secured against torsion, and a ball-shaped tang that engages a slit of a rider is present on the control slide. The tang is controlled by the rider and a control rod to control the fuel injection quantity.

12 Claims, 2 Drawing Sheets

FUEL INJECTION PUMP FOR INTERNAL COMBUSTION ENGINES

BACKGROUND OF THE INVENTION

The invention is based on a fuel injection pump as defined hereinafter.

Extraordinarily high pressures arise in the pump work chamber, on the order of 1300 bar and higher, and major demands in terms of injection quality are made of the injection pumps. This is true both for controlling the supply quantity of the fuel to be injected and for controlling the onset of supply. The quality of this control process depends in particular on the operating capacity of the control slide and on the relief bore cooperating with it. The control itself may be effected for instance via one or more oblique grooves disposed in a pump piston, which cooperate with the diversion bore in the control slide.

The cooperation of the control slide with the pump piston depends on the axial length of the control slide and on its rotational position with respect to the pump piston. However, injection pumps are also known in which because of various devices the control slide can move only axially on the pump piston, while the pump piston itself executes not only its reciprocating motion but also a rotation effected by a suitable adjusting device. In each case, the cooperation of the control slide and pump piston defines the onset of high-pressure injection, the injection stroke, and thus the duration of injection. Accordingly, the working capacity of the control depends on the length of the control stroke and on the angle of rotation of the pump piston or control slide. The axial displacement, for instance, of the control slide on the pump piston is determined primarily by the manner in which the control slide and a control rod are coupled.

In a known fuel injection pump (U.S. Pat. No. 2,147,390), the control slide in a variant embodiment moves on the pump piston by the cooperation of a gear wheel segment and a rack; the unavoidable play in a gear wheel drive does not allow accurate control courses.

In another known fuel injection pump of this type (European Patent 0 181 402), a ball-shaped adjusting tang of an adjusting mechanism disposed in the control rod engages the inside of a transverse groove of the control slide so that the adjusting mechanism causes the axial motion of the control slide on the pump piston.

A fuel injection pump of this type is also known (German Offenlegungsschrift 36 30 647), in which a ball-shaped adjusting tang secured to the control rod engages the inside of a transverse groove disposed in the control slide and adjusts it axially.

Another known fuel injection pump of this type (DE 36 33 899 Al) U.S. Pat. No. 4,811,716 also has a transverse groove in the control slide, which groove is engaged by a ball-shaped protrusion of the driver element, which is secured and adjustable on a control rod, and this protrusion then actuates the control slide.

Last but not least, a fuel injection pump of this type is known (from European Application 0 262 167) in which an anti-skid means, seated on an eccentric shaft of an adjusting bolt and engaging a transverse groove of the control slide, axially displaces the control slide.

All these known fuel injection pumps have a major disadvantage that the actuating elements o the control rod must engage transverse grooves of the control slide in order to axially displace it o the pump piston. The control slide must be structurally longer, however, which increases the total height of the pump and makes the pump more expensive. Moreover, the transverse grooves in the control slide weaken its cross section, which in turn can cause damage such as fissuring, given that reciprocating slide injection pumps are developed for very high injection pressures, with peak pressures of about 1000 bar.

OBJECT AND SUMMARY OF THE INVENTION

The fuel injection pump according to the invention has an advantage over the prior art that by reversing the intrinsically known disposition of the adjusting tang and slit, the structural length of the control slide can be kept smaller, thereby avoiding an increase in the structural height of the overall pump.

Another advantage is that the transverse grooves in the control slide are eliminated, thus strengthening of the cross section.

In another advantageous embodiment of the invention, a crowned or ball-shaped tang is disposed radially to the control slide; the control rod has riders, which are assigned to the various pump elements of the in-line injection pump.

In another advantageous embodiment of the invention, the riders have a slit in the longitudinal direction of the control rod, and the ball-shaped tangs of the control slides engage the slit so that the control slides can be moved axially on the pump piston by the riders.

In another advantageous feature of the invention, spacer plates are disposed between the control rod, which is flattened on its top, and the riders; this enables adjustment between the riders and control slides, for more accurate setting of the injection onset.

In another advantageous feature of the invention, the rider, with the spacer plate located above it, is firmly joined to the control rod by a suitable screw.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
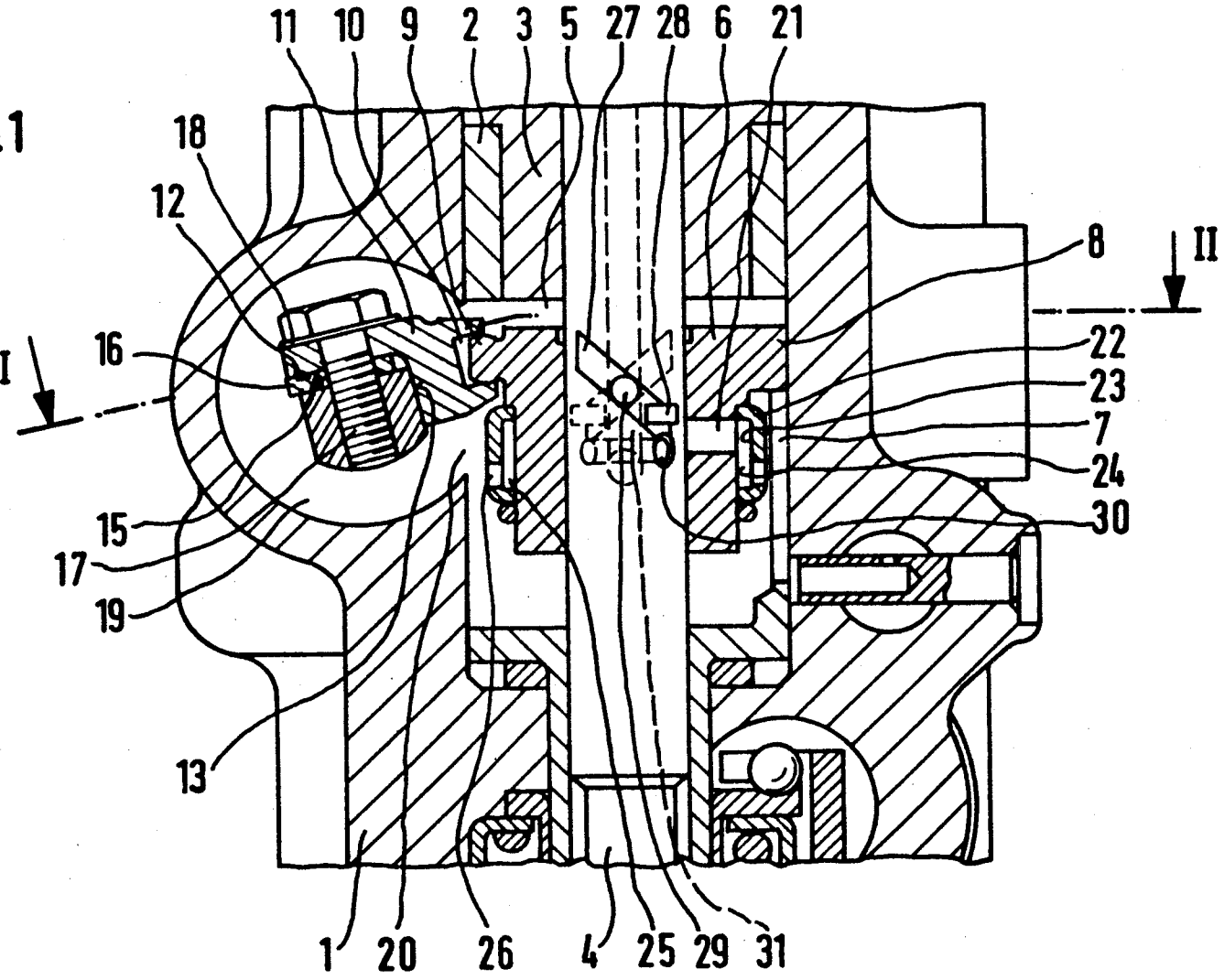
FIG. 1 is a fragmentary longitudinal section through a fuel injection pump according to the invention.
Figure 2:
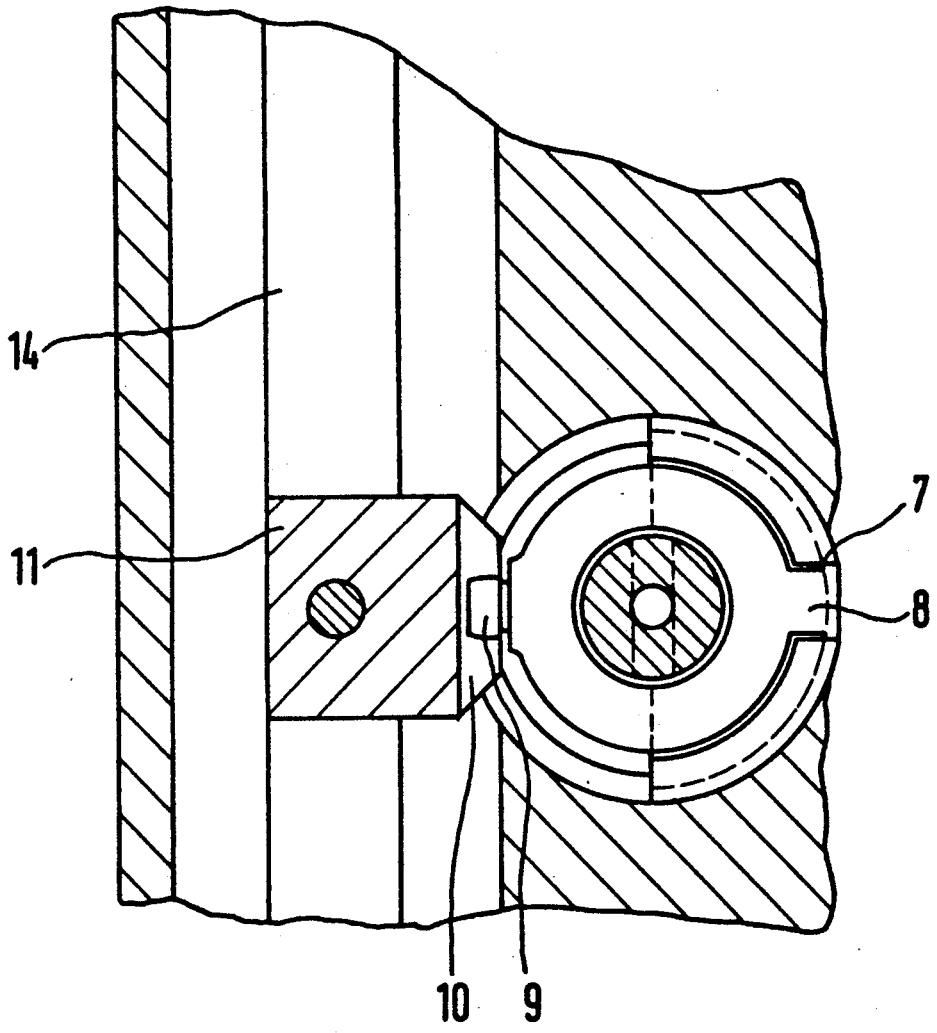
FIG. 2 is a section taken along the line II—II of FIG. 1.

A cylinder liner 3 in which a pump piston 4 is driven for its reciprocating motion by means not shown is inserted into a pump housing 1, shown only in part, having a pump cylinder 2. A recess 5 formed in the manner of a unilateral transverse opening is present in the pump cylinder 2 and receives a control slide 6 that is axially displaceable on the pump piston 4. A torsion guide is provided in the side wall of the recess 5; in it, a protrusion 8 of the control slide 6 slides in a longitudinal groove 7, thereby securing the control slide 6 against torsion, while allowing it to execute an axial motion on the pump piston 4. This axial motion of the control slide 6 is made possible by a ball-shaped tang 9 disposed radially on the control slide, opposite the groove 7 and protrusion 8; the tang engages a slit 10, extending in the longitudinal direction of a control rod 14 in a rider 11 virtually without play, and the rider 11 rests with one of its two bearing faces 12, which form a right angle, on a side wall 13 of the control rod 14. On its side toward the rider 11, the control rod is flattened and thereby forms a bearing face 15 for a fork-like spacer plate 16 disposed between the rider 11 and the bearing face 15.

the second bearing face 12 rests on the side of the spacer plate 16 oriented toward it; a screw 17 positively joins the rider 11 and the spacer plate 16 to the control rods 14 when they are in the adjusting state. To secure against torison of the screw 17, a securing shim 18 is disposed between the screw and the top of the rider.

In such a fuel injection pump, a plurality of such elements 2, 3, 4 having control slides 6 are advantageously disposed in line in the pump housing 1; they are then operated jointly by the control rod 14, whose riders 11 correspond in number to the number of pump elements. The control rod 14 and its riders 11 are disposed in a pump suction chamber 19, which is supplied with fuel at low pressure form a fuel tank via a feed pump in a manner not shown in further detail.

The entryway 20 to the recess 5 of the pump cylinder 5 is oriented toward this pump suction chamber 19, so that open communication exists between the recess 5 and the pump suction chamber 19.

A fuel diversion bore 21 is disposed in the control slide 6, and an impact ring 22 is provided in its vicinity; the impact ring has a turned recess 23 and with the jack face 24 of the control slide 6 forms an impact chamber 25. Outflow bores 26 are disposed at equal intervals on the circumference of the impact ring 22 and are staggered in their axial position with respect to the axis of the diversion bore 21 so that they do not cover one another. Dimensionally, the tolerances of the impact ring 22 are such that it easily rotates on the control slide 6. The control slide 6 is axially displaceable on the pump piston 4 by means of the control rod 14, the riders 11 with slits 10 and the ball-shaped tang 9; it communicates with recesses 28 on the pump piston 4, via the diversion bore 21 by means of opposed oblique grooves 27, and with the pump work chamber, not shown in the drawing, by means of transverse bores 29 and 30 and an axial bore 31. Oblique grooves and recesses are shown in German application P 41 00 093.5.

The exemplary embodiment shown functions as follows: A camshaft, not shown, sets the pump piston into reciprocating motion counter to the force of a spring. The pump piston 4 can be rotated in the cylinder liner 3 by means of a known control device. Depending on the rotational position of the pump piston 4 with its oblique grooves 27 and the recesses 28 in the control slide 6, the thereby-determined spacing of the oblique grooves 27 from the diversion bore 21 can be varied; this also likewise corresponds to a variably long injection stroke and thus to a variable duration of injection.

For axial displacement of the control slide 6 on the pump piston 4 and thus to control the injection onset, the control rod 14 in the pump suction chamber 19 is rotated, thereby changing the instant of injection. By using spacer plates 16 of different thicknesses, accurate adjustment of the control can be performed, by varying the spacing of the rider 11 with respect to the axis of rotation of the control rod 14.

The pump work chamber not shown in the drawing is filled with fuel during the intake stroke from the pump suction chamber 19 via the transverse bores 29 and 30 and the axial bore 31. In the compression stroke, fuel then flows back into the pump suction chamber 19, via the axial bore 31, the transverse bores 29 and 30 and the oblique grooves 27, until the transverse bores 29 and 30 have moved into the control slide 6 to block fuel flow. Only after that does the actual injection to the engine, which is thus dependent on the axial position of the control slide 6, begin. This injection is interrupted whenever the oblique grooves 27 are opened by the diversion bore 21 during the supply stroke.

The fuel, which is at high pressure in the pump work chamber and not injected during the compression stroke, thus shoots via the axial bore 31 and the transverse bore 2 through the diversion bore 21 into the impact chamber 25, is reflected there by the staggered position of the outflow bores 26, and flows via the outflow bores 26 and the recess 5 back into the pump suction chamber 19; the kinetic energy that the fuel still has as a result of the high pressure in the pump work chamber is virtually cancelled out in this process.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection pump for internal combustion engines including a housing (1), a pump cylinder (2) fixed in a suitable bore of the pump housing, a cylinder liner (3) in said pump cylinder, a pump piston in said cylinder liner (3) which is driven for a reciprocating working stroke and is rotatable for fuel control, at least one control slide that has a torsion guide and that for fuel control purposes is axially displaceable on the pump piston, a rounded tang (9) is radially disposed and embodied as a one-piece component of the control slide (6) and said tang cooperates with a fork-like rider (11) that fits around the tang (9), and said fork-like rider is operative by a control rod (14).

2. A fuel injection pump as defined by claim 1, in which the fork-like rider (11), in the longitudinal direction of the control rod (14) disposed at a tangent to the control slide, has a groove (10) extending transversely to the stroke motion, the inside of said groove is engaged virtually without play by the tang (9) in the axial direction of the control slide (6).

3. A fuel injection pump as defined by claim 1, in which the rider (11) is secured to the control rod (14) with a screw (17), on which a locking washer (18) is seated.

4. A fuel injection pump as defined by claim 2, in which the rider (11) is secured to the control rod (14) with a screw (17), on which a locking washer (18) is seated.

5. A fuel injection pump as defined by claim 3, in which a fork-like spacer plate (16) is disposed between the rider (11) and the control rod (14).

6. A fuel injection pump as defined by claim 4, in which a fork-like spacer plate (16) is disposed between the rider (11) and the control rod (14).

7. A fuel injection pump as defined by claim 5, in which spacer plates (16) are of different thickness.

8. A fuel injection pump as defined by claim 6, in which spacer plates (16) are of different thickness.

9. A fuel injection pump as defined by claim 1, in which first and second bearing faces (12), enclosing a right angle, are present on the rider (11), and that the rider (11) rests with the first bearing face (12) on a side wall (13) of the control rod (14), and the spacer plate (16) is disposed between the second bearing face (12) of the rider (11) and a third bearing face (15) of the control rod (14).

10. A fuel injection pump as defined by claim 2, in which first and second bearing faces (12), enclosing a right angle, are present on the rider (11), and that the rider (11) rests with the first bearing face (12) on a side wall (13) of the control rod (14), and the spacer plate (16) is disposed between the second bearing face (12) of the rider (11) and a third bearing face (15) of the control rod (14).

11. A fuel injection pump as defined by claim 3, in which first and second bearing faces (12), enclosing a right angle, are present on the rider (11), and that the rider (11) rests with the first bearing face (12) on a side wall (13) of the control rod (14), and the spacer plate (16) is disposed between the second bearing face (12) of the rider (11) and a third bearing face (15) of the control rod (14).

12. A fuel injection pump as defined by claim 4, in which first and second bearing faces (12), enclosing a right angle, are present on the rider (11), and that the rider (11) rests with the first bearing face (12) on a side wall (13) of the control rod (14), and the spacer plate (16) is disposed between the second bearing face (12) of the rider (11) and a third bearing face (15) of the control rod (14).

* * * * *